US010589826B2

(12) United States Patent
Gelin et al.

(10) Patent No.: US 10,589,826 B2
(45) Date of Patent: Mar. 17, 2020

(54) METHOD FOR TRANSFERRING LNG FROM A SHIP TO A FACILITY

(71) Applicant: GAZTRANSPORT ET TECHNIGAZ, Saint Remy les Chevreuse (FR)

(72) Inventors: Guillaume Gelin, Orsay (FR); Bertrand Bugnicourt, Dourdan (FR); Nicolas Vilmen, Massy (FR); Benjamin Charpentier, Paris (FR); Arnaud Landure, Guyancourt (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 75 days.

(21) Appl. No.: 15/112,738

(22) PCT Filed: Jan. 20, 2015

(86) PCT No.: PCT/EP2015/050935
§ 371 (c)(1),
(2) Date: Jul. 20, 2016

(87) PCT Pub. No.: WO2015/113857
PCT Pub. Date: Aug. 6, 2015

(65) Prior Publication Data

US 2016/0332703 A1 Nov. 17, 2016

(30) Foreign Application Priority Data

Jan. 31, 2014 (FR) ..... 14 50801

(51) Int. Cl.
*B63B 27/25* (2006.01)
*B63B 27/34* (2006.01)
(Continued)

(52) U.S. Cl.
CPC ..... *B63B 27/25* (2013.01); *B63B 25/08* (2013.01); *B63B 27/34* (2013.01); *B67D 9/02* (2013.01)

(58) Field of Classification Search
CPC .. B67D 9/00; B67D 9/02; B63B 27/34; B63B 27/25; B63B 27/08; B65H 75/00
(Continued)

(56) References Cited

U.S. PATENT DOCUMENTS 2,818,891 A * 1/1958 Loeser ..... B67D 9/02 119/14.18
2,927,607 A * 3/1960 Bily ..... B67D 9/02 137/236.1

(Continued)

FOREIGN PATENT DOCUMENTS

EP 2508417 A2 10/2012
JP S6088298 A 5/1985
JP 2011093551 A 5/2011

*Primary Examiner* — Timothy L Maust
*Assistant Examiner* — James R Hakomaki
(74) *Attorney, Agent, or Firm* — Notaro, Michalos & Zaccaria P.C.

(57) ABSTRACT

A system for transferring liquid natural gas from a ship to a facility, the transfer system comprising: a hoisting device which is designed to be secured on the deck of the ship; a mobile chassis, which is supported by the hoisting device; a first on-board pipe, for transferring liquid natural gas from the ship to the facility, said first on-board pipe being supported by the mobile chassis; and a second on-board pipe for the transport of inert gas, said second on-board pipe being supported by the mobile chassis comprising a first connection element which is associated with the second duct, and being connected to the first on-board pipe between the valve and the second connection element of the first on-board pipe.

17 Claims, 9 Drawing Sheets

(51) Int. Cl.
*B63B 25/08* (2006.01)
*B67D 9/02* (2010.01)

(58) Field of Classification Search
USPC ..... 141/382, 4, 11
See application file for complete search history.

(56) References Cited

U.S. PATENT DOCUMENTS 3,050,092 A * 8/1962 Palcanis ..... B63B 27/24 137/615
3,085,593 A * 4/1963 Sorensen ..... B67D 9/02 137/615
3,126,913 A * 3/1964 Green ..... B67D 9/02 137/356
3,199,553 A * 8/1965 Garrett ..... B63B 27/18 141/388
3,217,748 A * 11/1965 Harper ..... B67D 9/02 137/615
3,221,772 A * 12/1965 Arntzen ..... B67D 9/02 137/615
3,236,267 A * 2/1966 Bily ..... B63B 22/023 141/1
3,463,114 A * 8/1969 Lovell ..... B63B 21/00 114/230.16
3,825,045 A * 7/1974 Bloomquist ..... B67D 7/00 141/198
3,921,684 A * 11/1975 Allen ..... B63B 27/24 141/279
3,974,794 A * 8/1976 Kakitani ..... B63B 21/00 114/230.15
4,099,542 A * 7/1978 Gibbons ..... B67D 9/02 137/615
4,276,917 A * 7/1981 Fujita ..... B67D 9/02 141/387
4,867,211 A * 9/1989 Dodge ..... B63B 27/24 137/615
6,637,479 B1 * 10/2003 Eide ..... B63B 27/24 114/230.1
6,938,570 B2 * 9/2005 Montgomery ..... B63B 21/00 114/230.1
6,938,643 B2 * 9/2005 Pollack ..... B63B 27/24 137/615
7,610,934 B2 * 11/2009 Naciri ..... B63B 27/24 137/615
7,793,605 B2 * 9/2010 Poldervaart ..... B63B 21/04 114/230.15
8,286,678 B2 10/2012 Adkins et al.
8,499,709 B2 * 8/2013 Lee ..... B63B 21/00 114/230.19
8,881,538 B2 * 11/2014 Dupont ..... B63B 27/24 137/615
9,731,795 B2 * 8/2017 Deletre ..... B63B 27/24
2006/0081166 A1 * 4/2006 Montgomery ..... B63B 21/00 114/230.1
2007/0029008 A1 * 2/2007 Liu ..... F16L 59/141 141/387
2007/0289517 A1 * 12/2007 Poldervaart ..... B63B 21/04 114/230.15
2007/0292243 A1 12/2007 De Baan
2010/0000252 A1 * 1/2010 Morris ..... B63B 27/24 62/611
2010/0313977 A1 * 12/2010 Sylard ..... B25J 9/1689 137/615
2011/0066290 A1 * 3/2011 Le Devehat ..... B63B 27/24 700/279
2011/0232767 A1 * 9/2011 Liem ..... B63B 27/24 137/1
2012/0067434 A1 * 3/2012 Foo ..... B63B 27/34 137/15.01
2012/0152366 A1 * 6/2012 Foo ..... B63B 27/34 137/1
2013/0240085 A1 * 9/2013 Hallot ..... B63B 27/24 141/311 R
2014/0301807 A1 * 10/2014 Hallot ..... B63B 27/34 414/137.9
2015/0329184 A1 * 11/2015 Deletre ..... B63B 27/24 248/81

* cited by examiner

METHOD FOR TRANSFERRING LNG FROM A SHIP TO A FACILITY

TECHNICAL FIELD

The invention relates to the field of the transfer of fluid, and relates more particularly to the transfer of liquid natural gas (LNG) between a supplier ship and a facility, such as a client ship.

TECHNOLOGICAL BACKGROUND

In the prior art, systems are known which make it possible to transfer LNG at sea between a supplier ship and a client ship. A transfer system of this type is described for example in U.S. Pat. No. 8,286,678.

U.S. Pat. No. 8,286,678 describes a system which comprises on the supplier ship side four flexible ducts, three of which make it possible to transfer LNG from the supplier ship to the client ship, and one of which makes it possible to extract natural gas in the gaseous state from the client ship to the supplier ship, in order to balance the pressures in the gas overlay of the tanks of the two ships. The system also comprises an articulated arm, fitted on a platform of the supplier ship, and a mobile chassis which is supported by said articulated arm. The mobile chassis supports the ends of the four flexible ducts, and comprises means which make it possible to connect them to ducts of the client ship. In addition, the mobile chassis is secured against the hold of the client ship by means of a sucker or electromagnet device.

Since LNG is inflammable in the presence of oxygen, the pipes of the client ship and the supplier ship are inerted and purged by sweeping by inert gas, implemented before and after the LNG transfer operations.

For this purpose, the inert gas is circulated through the flexible ducts of the ship, and is conveyed to the pipes of the client ship to be inerted. Consequently, the aforementioned inerting operations are particularly lengthy, since they make it necessary to inert the flexible ducts of the supplier ship along their entire length.

In addition, in order to be able to initiate the transfer of the LNG, the ducts of the client ship have to be put into temperature and pressure conditions which permit the transfer of the LNG without giving rise to substantial evaporations of natural gas. For this purpose, LNG is generally kept in the ducts of the supplier ship, or LNG is circulated in these ducts, in order to keep them in or put them into acceptable temperature conditions.

However, once the ducts of the supplier ship are swept by an inert gas, their temperature rises to above acceptable conditions. Thus, after the sweeping of the ducts of the supplier ship by inert gas, said ducts must be previously cooled before envisaging transfer of LNG without excessive evaporation.

Thus, the transfer conditions according to the prior art do not give entire satisfaction, in particular as far as the operations before the transfer of the LNG are concerned, i.e. the connection, inerting and cooling are particularly lengthy.

SUMMARY

A concept on which the invention is based is to propose a transfer system for transferring LNG between a ship and a facility which concept makes it possible to carry out the transfer of LNG from the ship to the facility simply, rapidly and safely.

According to one embodiment, the invention provides a transfer system for transferring liquid natural gas from a ship to a facility, the transfer system comprising:

- a hoisting device which is designed to be secured on a deck of the ship;
- a mobile chassis, which is supported by the hoisting device;
- a first duct, for transferring liquid natural gas from the ship to the facility, which has a first end designed to be connected to a liquid natural gas storage tank of the ship, and a second end;
- a second duct, for the transport of inert gas, comprising a first end which is designed to be connected to an inert gas storage tank of the ship, and a second end;
- a first on-board pipe for transferring liquid natural gas from the ship to the facility, said first on-board pipe being supported by the mobile chassis and comprising:
  - a first connection element which is associated with the second end of the first duct;
  - a second connection element which is designed for the connection of the first on-board pipe to a duct of the facility for transferring liquid natural gas to the facility; and
  - a valve which is arranged between the first and the second connection elements; and
- a second on-board pipe for the transport of inert gas, said second on-board pipe being supported by the mobile chassis, comprising a first connection element which is associated with the second end of the second duct, and being connected to the first on-board pipe, between the valve and the second connection element of the first on-board pipe.

Thus, a transfer system of this type does not require inerting of the entire length of the first duct on the supplier ship side. Consequently, the duct for the transfer of LNG can be kept in a state ready for use during the inerting. Thus, the operations before the transfer of LNG to the facility are carried out more rapidly.

According to embodiments of the invention, a transfer system of this type can comprise one or more of the following characteristics:

the transfer system comprises:

- a third duct for the extraction of the natural gas in a gaseous state from the facility to the ship, the third duct comprising a first end which is designed to be connected to equipment of the ship, and a second end; and
- a third on-board pipe for the extraction of the natural gas in the gaseous state from the facility to the ship, said third on-board pipe being supported by the mobile chassis and comprising:
  - a first connection element which is associated with the second end of the third duct;
  - a second connection element which is designed for the connection of the third on-board pipe to a duct of the facility for extraction of the natural gas in the gaseous state from the facility; and
  - a valve which is arranged between the first and the second connection elements;

the second on-board pipe also being connected to the third on-board pipe, between the valve and the second connection element of the third on-board pipe;

the transfer system comprises a branching section which is supported by the mobile chassis, equipped with a valve and connecting the first on-board pipe, between its first connection element and its valve, to the third on-board pipe, between its first connection element and its valve;

the second on-board pipe is connected to the first on-board pipe, and, if applicable, to the third on-board pipe, respectively by means of a first connection section, and, if applicable, a second connection section, each of said connection sections being equipped with a valve;

the second on-board pipe comprises a second connection element which is designed for the connection of the second on-board pipe to a duct of the facility;

one out of the first on-board pipe, the second on-board pipe and/or the third on-board pipe is equipped with an emergency disconnection device;

one out of the first on-board pipe, the second on-board pipe and/or the third on-board pipe comprises a flexible portion which, firstly, is connected to an emergency disconnection device, and secondly has a free end supporting a second connection element which can be connected to a pipe of the facility;

the first duct, the second duct and/or the third duct is/are flexible;

the first duct, the second duct and/or the third duct comprise(s) at least two rigid portions which are connected to one another by at least one rotating joint;

the mobile chassis comprises an element for temporary securing of the mobile chassis on the facility;

the element for temporary securing of the mobile chassis on the facility is a sucker which is connected to a vacuum generator, or an electromagnet;

the hoisting device is an articulated arm comprising a hydraulic or pneumatic actuating device;

the transfer system additionally comprises a control device which can place the actuating device selectively in an active state, in which the actuating device is maintained under pressure greater than, or equal to, the pressure of equilibrium, in order to permit retention in position and/or displacement of the articulated arm, and in a released state, in which the pressure in the actuating device is released, in order to shut off the articulated arm, such that it can follow the relative movements between the ship and the facility;

the transfer system additionally comprises a control device which can place the actuating device selectively in an active state, in which the pressure in the actuating device is regulated in order to permit retention in position and/or displacement of the articulated arm, and in a support assistance state, in which the actuating device is maintained under pressure, at a pressure lower than a pressure of equilibrium, whilst permitting its displacement, in order to allow the system to follow the relative movements of the ships, whilst continuing to support partly the mobile chassis.

According to one embodiment, the invention also includes a ship which is equipped with a transfer system as previously described.

According to one embodiment, the invention also provides a method for transferring liquid natural gas from a ship to a facility by means of an aforementioned system, said transfer system being connected to a facility comprising a duct for transferring the liquid natural gas to the facility, which is firstly connected to a liquid natural gas storage tank of the facility, and secondly is connected to the first on-board pipe of the transfer system, said method comprising:

an inerting step, in which the valve of the first on-board pipe is in the closed position and inert gas is conveyed from the second duct to said duct of the facility by means of the second on-board pipe and the first on-board pipe.

According to some embodiments, a transfer system of this type can comprise one or more of the following characteristics:

the transfer system is connected to a facility additionally comprising a duct for extraction of the natural gas in the gaseous state which is connected to the liquid natural gas storage tank of the facility, said transfer system comprising:

a third flexible duct for extraction of the natural gas in the gaseous state from the facility to the ship, comprising a first end which is connected to equipment of the ship, and a second end; and a third on-board pipe for extraction of the natural gas in the gaseous state from the facility to the ship, said third on-board pipe being supported by the mobile chassis and comprising:

a first connection element which is associated with the second end of the third duct;

a second connection end which connects the third on-board pipe to the duct of the facility for the extraction of the natural gas in the gaseous state; and a valve which is arranged between the first and the second connection elements;

the second on-board pipe for the transfer of inert gas being connected to the third on-board pipe, between the valve and the second connection element of the third on-board pipe;

wherein, during the inerting step, the valve of the third on-board pipe is in the closed position, and inert gas is conveyed from the second duct to said second duct of the facility for the extraction of the natural gas in the gaseous state, by means of the second on-board pipe and the third on-board pipe;

the transfer system comprises a branching section which is supported by the mobile chassis and is equipped with a valve, and connects the first on-board pipe, between its first connection element and its valve, to the third on-board pipe, between its first connection element and its valve, said method comprising a step of cooling the first and third ducts, during which the valves of the first and third on-board pipes are in the closed position, and the valve of the branching section is in the open position, and liquid natural gas is conveyed from the first duct to the third duct through the branching section.

BRIEF DESCRIPTION OF THE FIGURES

The invention will be better understood, and other objectives, details, characteristics and advantages of it will become more apparent from the following description of a plurality of particular embodiments of the invention, provided purely by way of non-limiting illustration, with reference to the appended drawings.

DETAILED DESCRIPTION OF EMBODIMENTS

In relation with FIGS. 1 and 2, a description will be provided hereinafter of a transfer system which makes it possible to transfer liquid natural gas (LNG) between a supplier ship 1 and a client ship 2. The supplier ship 1 is for example a bunker vessel responsible for replenishing LNG to other ships, and the client ship 2 is a ship which runs on LNG.

Figures 1, 12, 13:
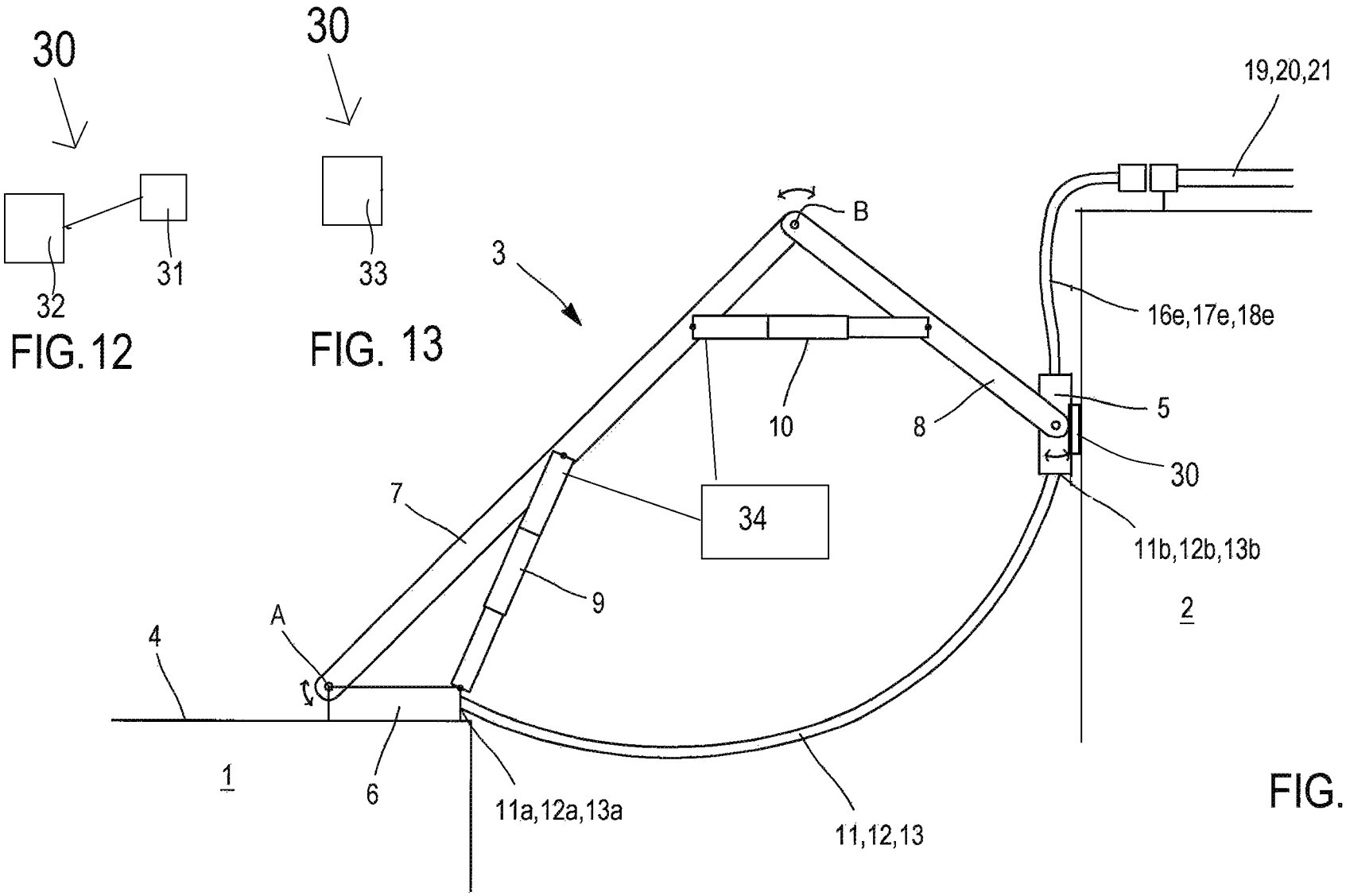
FIG. 1 illustrates schematically a fluid transfer system, during an operation of transfer of LNG from a supplier ship to a client ship.
FIG. 12 illustrates schematically a temporary securing element which comprises one sucker which is connected to a vacuum generator.
FIG. 13 illustrates schematically a temporary securing element which comprises one electromagnet.

With reference to FIG. 1, the transfer system comprises a hoisting device 3 which is secured on the deck 4 of the supplier ship 1, and supports at its end a mobile chassis 5 which is designed to be secured on the hull of the client ship 2.

The deck 4 can in particular be equipped with a platform on which the hoisting device 3 is mounted. In the embodiment represented, the hoisting device 3 is an articulated arm. The arm is fitted in a articulated manner on the deck 4 of the supplier ship 1, by means of a rotary plate 6 which can rotate around a vertical axis.

In addition, the articulated arm comprises a first portion 7 which is mounted such as to pivot relative to the deck 4 of the supplier ship 1 around an axis A, and a second portion 8 which is mounted such as to pivot on the distal end of the first portion 7 around an axis B.

In order to permit the deployment of the articulated arm, the latter is equipped with a hydraulic or pneumatic actuating device. The actuating device comprises a first jack 9 which has a first end mounted in an articulated manner on the rotary plate 6, and a second end which is mounted in an articulated manner on the first portion 7 of the arm, and a second jack 10 with a first end which is mounted in an articulated manner on the first portion 7, and a second end which is mounted in an articulated manner on the second portion 8.

The mobile chassis 5 is equipped with one or a plurality of temporary securing elements 30, which make it possible to secure it against the hull of the client ship 2. A securing element of this type can in particular comprise one or a plurality of suckers 31 which are connected to a vacuum generator 32 as schematically shown in FIG. 12, or one or a plurality of electromagnets 33 as schematically shown in FIG. 13. Securing elements of this type are particularly advantageous in that they make it possible to secure the mobile chassis 5 on the hull of the client ship 2, and to release this fastening simply and rapidly, without intervention by an operator.

The hoisting device comprises a device 34 for control of the actuating device. In an active state, the control device 34 regulates the pressure in the actuating device, such as to permit the deployment, retraction, or support of the articulated arm.

In addition, the control device 34 is designed to allow the articulated arm to follow the relative movement between the supplier ship 1 and the client ship 2 when the mobile chassis 5 is secured against the hull of the client ship 2. For this purpose, according to a first embodiment, the control device can place the actuating device in a released state, in which the pressure in the hydraulic or pneumatic circuit of the actuating device is released in order to shut off the articulated arm. According to a second embodiment, the control device places the actuating device in a support assistance state, in which the actuating device is kept under pressure, but at a pressure lower than the pressure of equilibrium of the actuating device, which makes it possible to support the articulated arm, whilst permitting its displacement, in order to allow the system to follow the relative movements of the ships, whilst continuing to support the mobile chassis partly.

Figure 2:
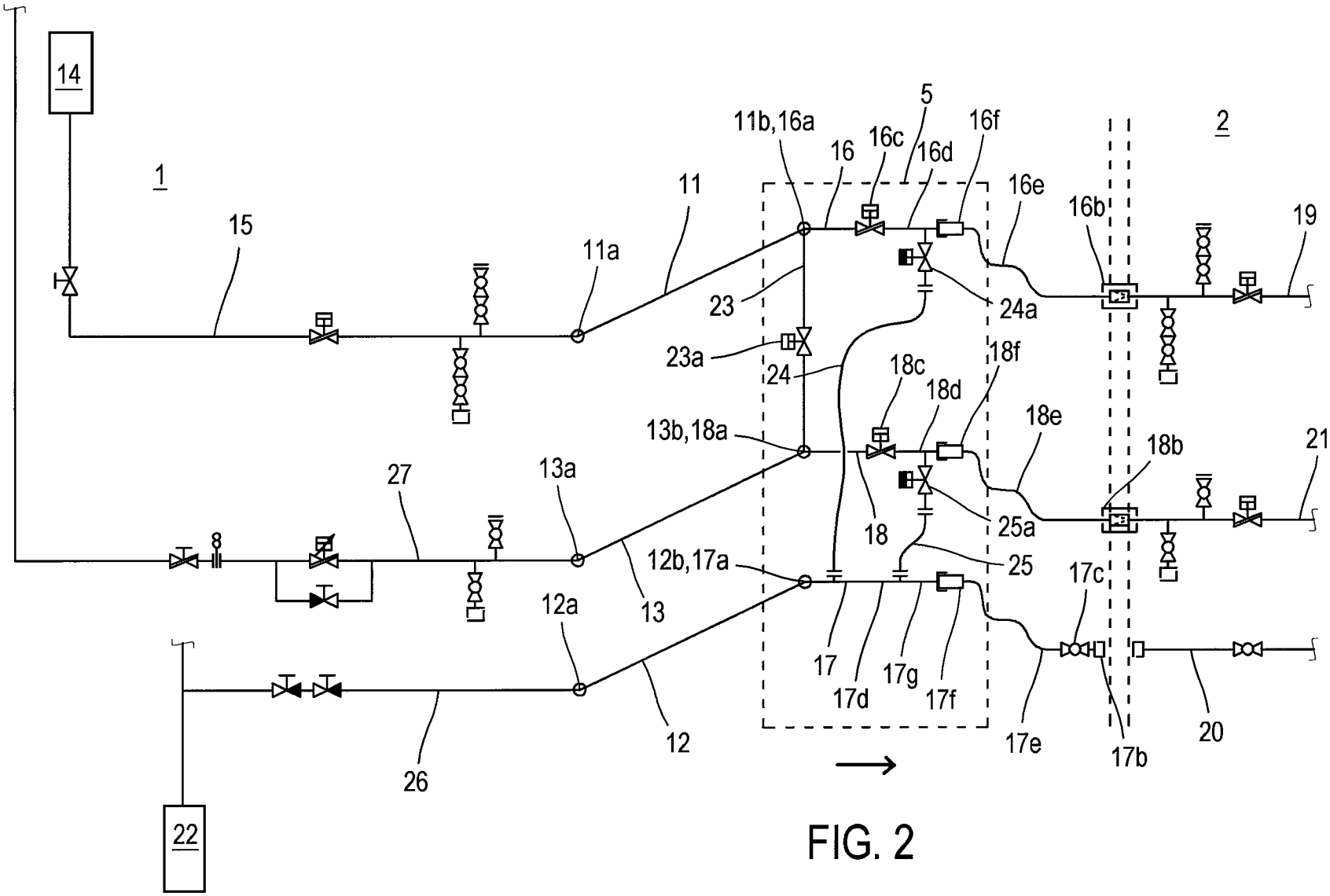
FIG. 2 illustrates schematically the flow circuits of the fluids in the transfer system in FIG. 1.

In addition, the transfer system represented in FIG. 2 comprises three ducts 11, 12, 13 which extend between the deck 4 of the supplier ship 1 and the mobile frame 5.

A first duct 11 is designed for the transfer of LNG from the supplier ship 1 to the client ship 2. The first duct 11 comprises a first end 11*a* which is connected to an LNG storage tank 14 of the supplier ship 2 via a pipe 15, and a second end 11*b* which is connected to a first on-board pipe 16 supported by the mobile chassis 5.

A second duct 12 is designed for the transport of an inert gas. The second duct 12 comprises a first end 12*a* which is connected to an inert gas storage tank 22 via a pipe 26, and a second end 12*b* which is associated with a second on-board pipe 17 supported by the mobile chassis 5. The inert gas is a non-combustible and non-combustive gas or gaseous mixture. The inert gas typically consists of nitrogen, which is chemically neutral and inexpensive.

Finally, a third duct 13 is designed for the extraction of the natural gas (NG) in the gaseous state from the client ship 2 to the supplier ship 1. The first end 13*a* of the third duct 13 is connected to an LNG storage tank 14 or to a facility for re-liquefaction of the natural gas on board the supplier ship 1, by means of a duct 27.

The second end 13*b* of the third flexible duct 13 is associated with a third on-board pipe 18 which is supported by the mobile chassis 5.

The supplier ship 1 is equipped with pumps, not represented, which make it possible to generate the pressure necessary for the transfer of the natural gas and the inert gas.

Figure 8:
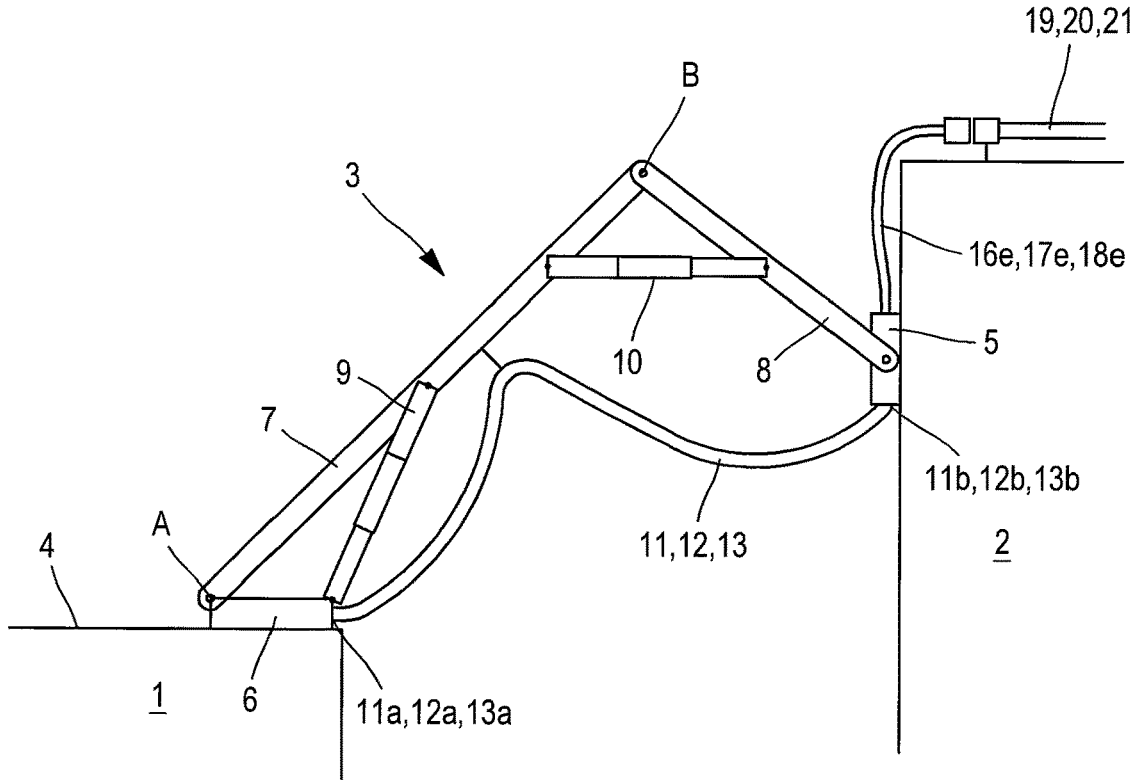
FIGS. 8, 9 and 10 illustrate schematically a fluid transfer system, during an operation of transfer of LNG from a supplier ship to a client ship, according to a second, a third and a fourth embodiment.

In the embodiment represented in FIGS. 1 and 8, the first, second and third ducts 11, 12, 13 are flexible ducts, such as to permit the movement of the mobile chassis 5 relative to the deck 4 of the supplier ship 1. It will also be noted that, in the embodiment in FIG. 8, the first, second and third flexible ducts 11, 12, 13 are suspended at a median portion on the articulated arm.

Figure 9:
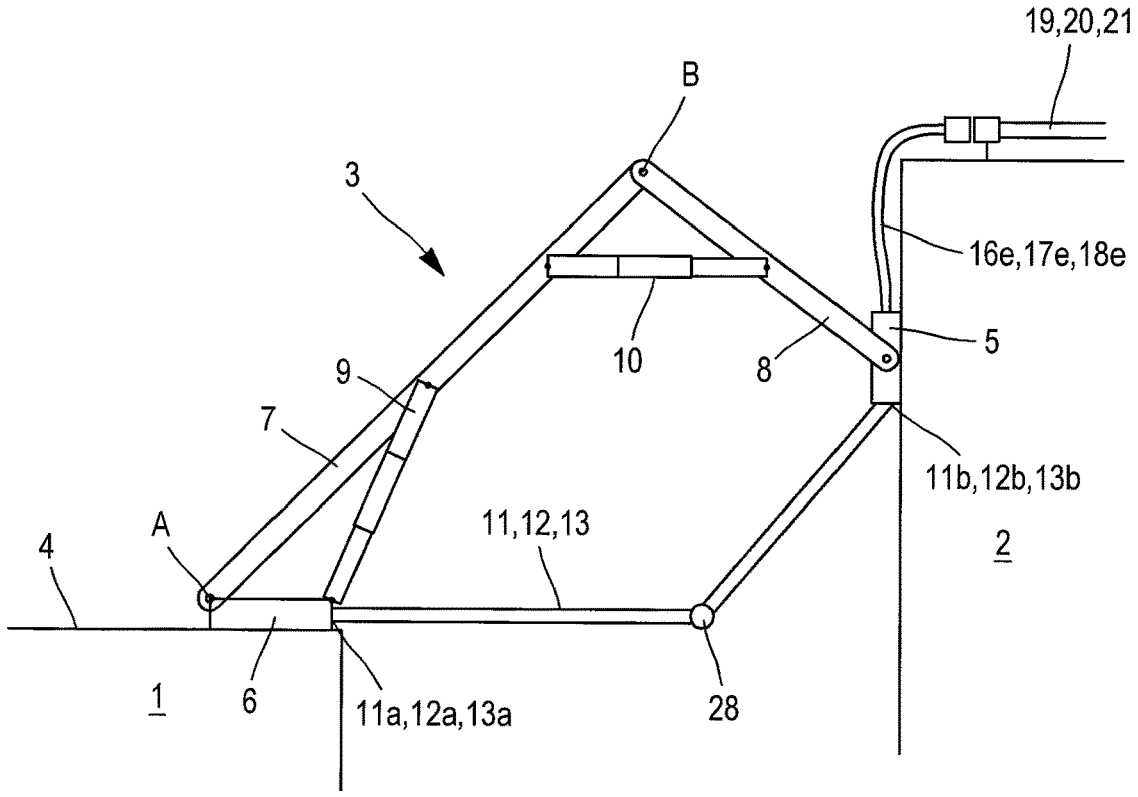
Figure 10:
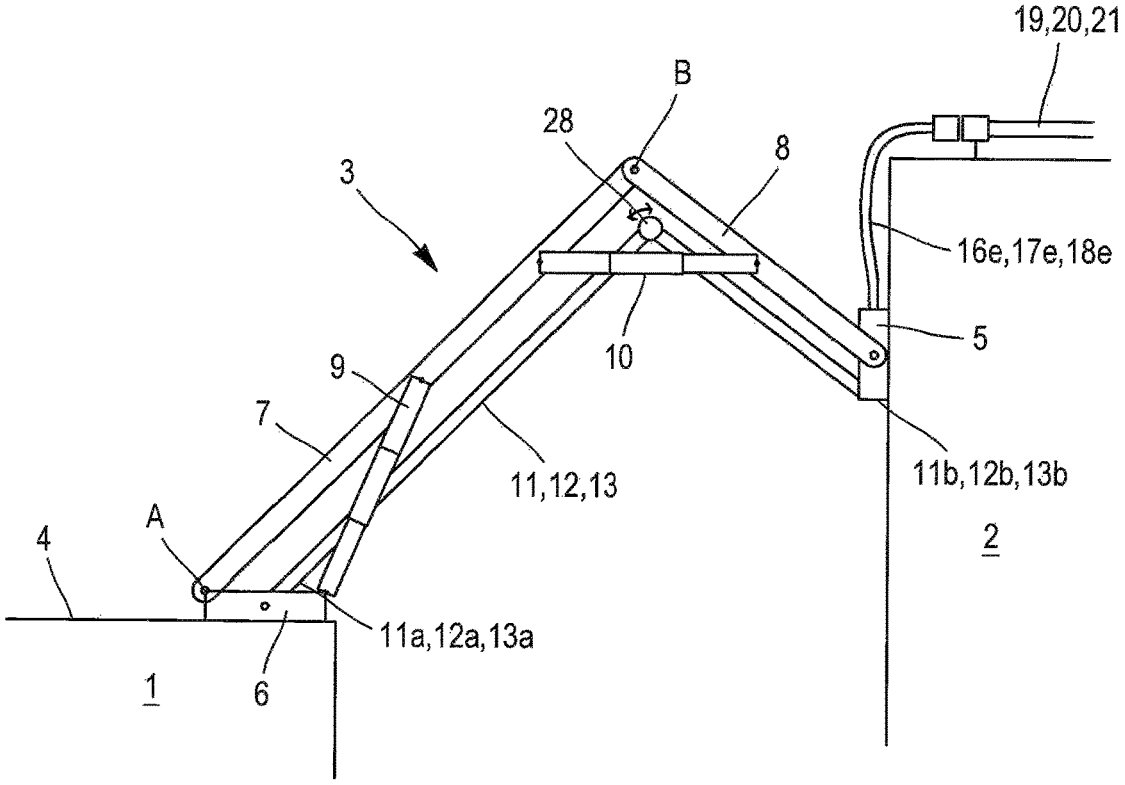
Figure 11:
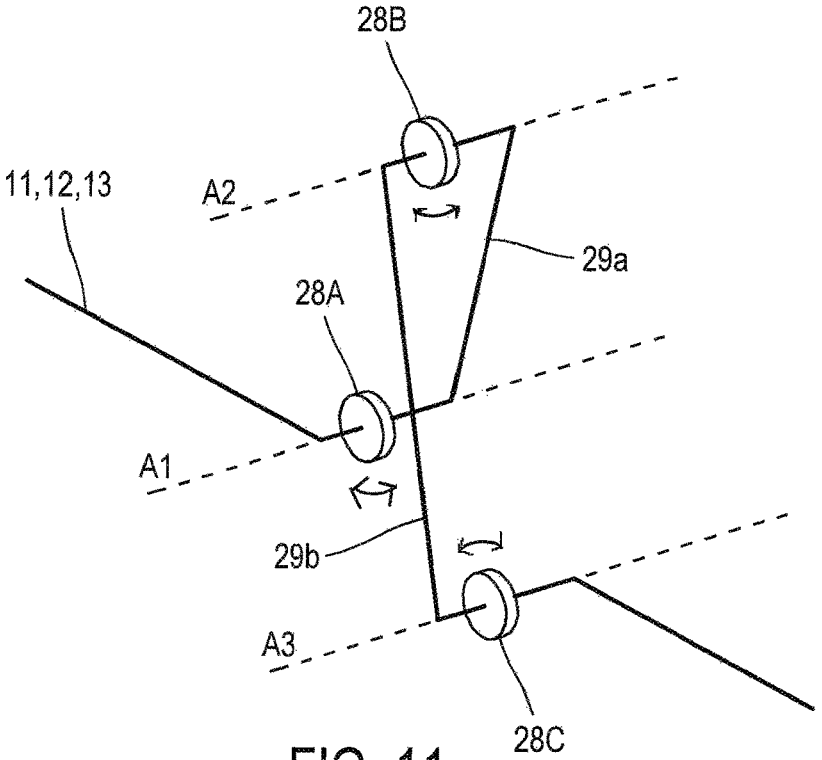
FIG. 11 illustrates a set of three rotating joints.

In the embodiments represented in FIGS. 9 and 10, the first, second and third ducts 11, 12, 13 each comprise at least two rigid portions which are connected to one another by a rotary joint 28, also known as a rotary connection. A rotary joint of this type ensures connection in rotation, without leakage, between the two rigid portions of the first, second and third ducts 11, 12, 13. The rotary joint 28 has a horizontal axis of rotation. When the transfer system comprises only one rotary joint 28, its axis is coaxial to the axis of articulation A, between the first portion 7 and the second portion 8 of the articulated arm. In the embodiment represented schematically in FIG. 11, the two portions of a duct 11, 12, 13 are connected to one another by means of three rotary joints 28*a*, 28*b*, 28*c* which have parallel and horizontal axes of articulation A1, A2, A3. The rotary joints 28*a*, 28*b*, 28*c* are connected by rigid tubes 29*a*, 29*b*. Thanks to an arrangement of this type of rotary joints 28*a*, 28*b*, 28*c*, it is not necessary for one of the axes of articulation A1, A2, A3 of the rotary joints 38*a*, 38*b*, 38*c* to be aligned with the axis of articulation A between the first portion 7 and the second portion 8 of the articulated arm. In addition, the first ends 11*a*, 12*a*, 13*a* and the second ends 11*b*, 12*b*, 13*b* of the first, second and third ducts 11, 12, 13 can also be equipped with one or a plurality of rotary joints.

It will also be noted that, in the embodiment in FIG. 10, the first, second and third ducts 11, 12, 13 are suspended on the articulated arm.

In addition, the mobile chassis 5 supports the first on-board pipe 16, which makes it possible to transfer the LNG from the supplier ship 1 to the client ship 2. The first on-board pipe 16 comprises a first connection element 16*a* which makes it possible to connect said first on-board pipe 16 to the second end 11*b* of the first duct 11. The first on-board pipe 16 additionally comprises a second connection element 16*b* which is designed to connect said first on-board pipe 16 to a duct 19 of the client ship 2, via a manifold. The duct 19 is connected to an LNG storage tank, not represented, of the client ship 2.

According to the present description, "connection element" means any element which makes it possible to connect at least two pipes or ducts in a sealed manner.

The first on-board pipe 16 comprises in succession a first portion 16*d* which is secured on the mobile chassis 5, then a second, flexible portion 16*e* which supports the second connection element 16*b*. This second, flexible portion 16*e* makes it possible to facilitate the operations of connection of the first on-board pipe 16 on the manifold of the client ship 2, and also makes it possible to limit the forces absorbed at the connection between the first on-board pipe 16 and the manifold of the client ship 2.

The second flexible portion 16*e* is connected to the first portion 16*d* by means of an emergency disconnection device 16*f* which makes it possible to disconnect and interrupt the transfer of the LNG. An emergency disconnection device 16*f* of this type is commonly designated by the term ERC for "Emergency Release Coupling". The first portion 16*d* of the first on-board pipe 16 is equipped with a valve 16*c*. According to one embodiment, the valve 16*c* is an emergency stop valve which makes it possible in particular to cut off the transfer of LNG when an alarm signal has been generated. An alarm signal of this type can in particular be generated manually or automatically, in the case of detection of fire or a leakage, a power cut, failure of a pump, or detection of abnormal temperature or pressure conditions.

The mobile chassis 5 also supports the third on-board pipe 18 which makes it possible to extract the NG in the gaseous state from the client ship 2 to the supplier ship 1. The third on-board pipe 18 comprises a first connection element 18*a* which makes it possible to connect the third on-board pipe 18 to the second end 13*b* of the third duct 13, and a second connection element 18*b* which is designed to connect the third on-board pipe 18 to a duct 21 of the client ship 2 via a manifold. The duct 21 of the client ship is connected to the gas overlay of the LNG storage tank of the client ship 2.

The third on-board pipe 18 comprises a structure similar to that of the first on-board pipe 16. Thus, the third on-board pipe 18 comprises a first portion 18*d* which is secured on the mobile chassis 5 and is provided with a valve 18*c*, a second flexible portion 18*e* which supports the second connection element 18*b*, and an emergency disconnection device 18*f* which connects the first portion 18*d* and the second, flexible portion 18*e*.

The mobile chassis 5 additionally supports a branching section 23 which connects the first pipe 16 and the third pipe 18. The branching section 23 comprises a valve 23*a*, and opens into each of the first and third pipes 16, 18, between their first connection element 16*a*, 18*a*, and their valve 16*c*, 18*c*. The branching section 23 makes it possible to establish circulation of LNG which allows the first duct 11 to be put into acceptable temperature conditions, before transferring LNG to the client ship 2.

In addition, the mobile chassis 5 supports a second on-board pipe 17 which is connected to the inert gas storage tank 22 by means of the second duct 12. The second on-board pipe 17 comprises a first connection element 17*a* for the connection of the second on-board pipe 17 to the second end 12*b* of the second duct 12. The second on-board pipe 17 is connected to the first pipe 16 by means of a connection section 24. The connection section 24 is equipped with a valve 24*a*. The connection section 24 opens into the first on-board pipe 16, between the valve 16*c* and the second connection element 16*b*. Similarly, the second on-board pipe 17 is connected to the third on-board pipe 18 by means of a connection section 25 which is equipped with a valve 25*a*. The connection section 25 opens into the third on-board pipe 18 between the valve 18*c* and the second connection element 18*b*. The connection sections 24, 25 are connected firstly to the second on-board pipe 17, and secondly to the first or to the third on-board pipe 16, 18, by means of three-way connections.

Thus, the inert gas can be injected directly at the end of the first and third on-board pipes 16, 18 and the pipes 19, 21 of the client ship 2, without previously passing via the first and third ducts 11, 13.

In addition, in certain cases, the client ship 2 is equipped with an inert gas storage tank. Thus, the second on-board pipe 17 can be connected to a duct 20 of the client ship 3, in order to permit transfer of inert gas from the supplier ship 1 to the client ship 2. Also, the second on-board pipe 17 comprises a first portion 17*d* which is secured on the mobile chassis 5, a second, flexible portion 17*e* which supports a second connection element 17*b* making it possible to connect the second on-board pipe 17 to a duct 20 of the client ship 2, and an emergency disconnection device 17*f* which connects the first portion 17*d* and the second, flexible portion 17*e*. The second on-board pipe 17 is also provided with a valve 17*c* which, in the embodiment represented, is supported by the second flexible portion 17*d*.

In the embodiment represented, the transfer system comprises only a single LNG transfer line to the client ship 2. However, the invention is not limited to such an embodiment, and the transfer system can also comprise a plurality of ducts 11 which are designed for the transfer of LNG from the supplier ship 1 to the client ship 2, and a plurality of on-board pipes 16, which make it possible to connect the ducts 11 to pipes 19 of the client ship 2. In this case, each of the ducts 11 is connected to the second on-board pipe 17 by means of a connection section 24.

In addition, although in the embodiment represented the transfer system is equipped with an extraction line which makes it possible to extract natural gas in the gaseous state from the client ship 2 to the supplier ship 1, the invention is in no way limited to such an embodiment, and the transfer system can be without such an extraction line. In particular, when the LNG storage tank of the supplier ship 1 is a tank of type C, i.e. a cylindrical tank which makes it possible to store the natural gas under pressure, the LNG can be transferred to the client ship 2 by maintaining in the tank 14 of the supplier ship 1 a pressure which is higher than that which exists in the tank of the client ship 2. In this case, there is no need to provide for extraction of the natural gas from the gas overlay of the client ship 2 to the supplier ship 1. In addition, no pump is necessary for the transfer of the LNG.

FIGS. 3 to 7 illustrate a sequence of operations implemented during an operation of supply of LNG to a client ship 2 by a supplier ship 1.

Figure 3:
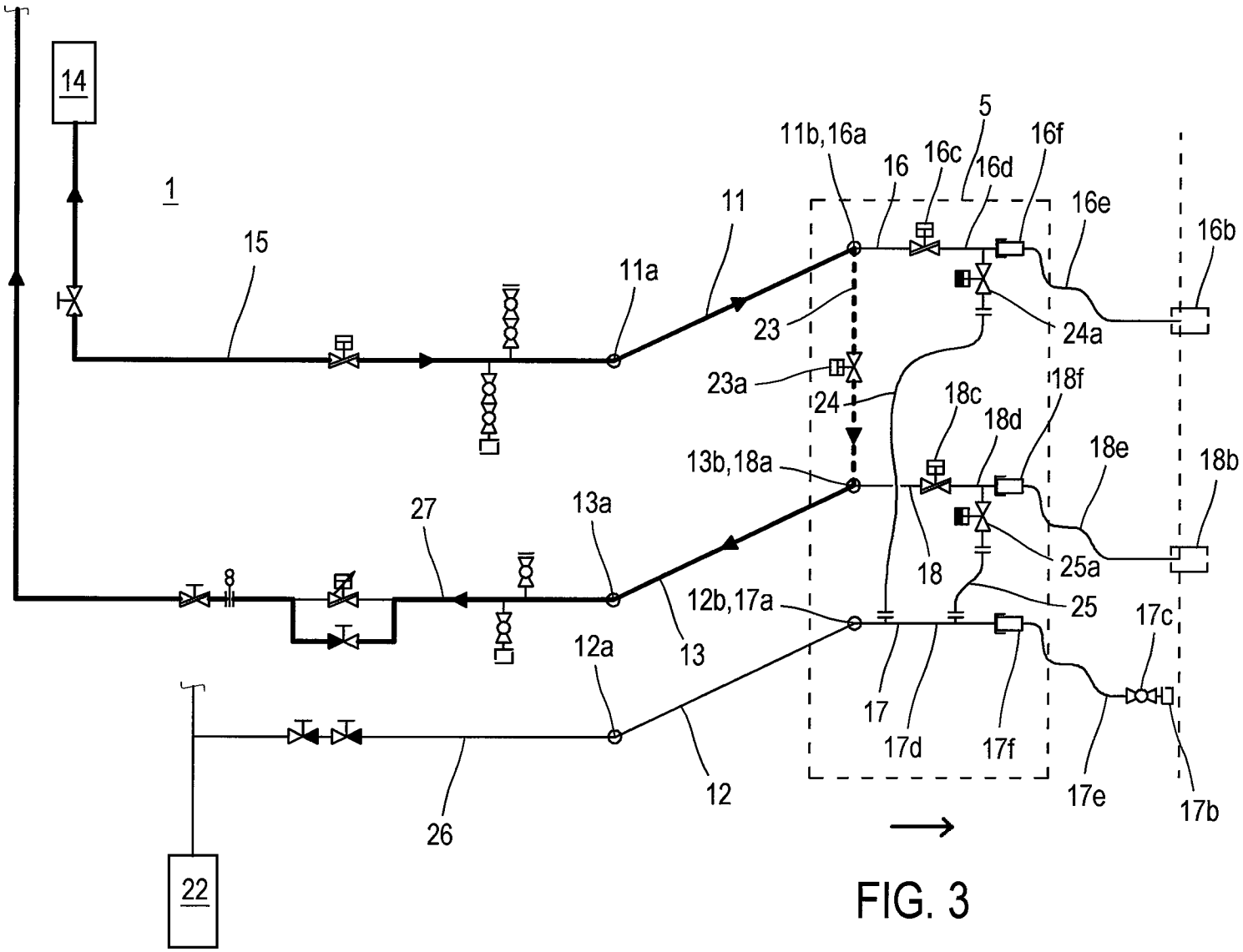
FIG. 3 illustrates schematically the circulation of the LNG in the transfer system in FIGS. 1 and 2, during a preliminary operation of cooling of the flexible ducts of the transfer system.

During a first, preliminary step of cooling the first and third ducts 11, 13, illustrated in FIG. 3, LNG is circulated through the first duct 11 and the third duct 13, such as to put them into temperature and pressure conditions suitable for the transfer of LNG. For this purpose, the LNG is conveyed through the first duct 11, then is conveyed via the branching section 23 to the third duct 13, in order to return to the LNG storage tank 14. In order to permit this circulation of LNG, the valves 16*c*, 18*c* of the first and third on-board pipes 16, 18 are in the closed position, whereas the valve 23 which equips the branching section is in the open position. This preliminary step can be implemented during the phase of approach of the supplier 1 and client 2 ships, whilst the mobile chassis 5 is not yet secured on the hull of the client ship 2.

Figure 4:
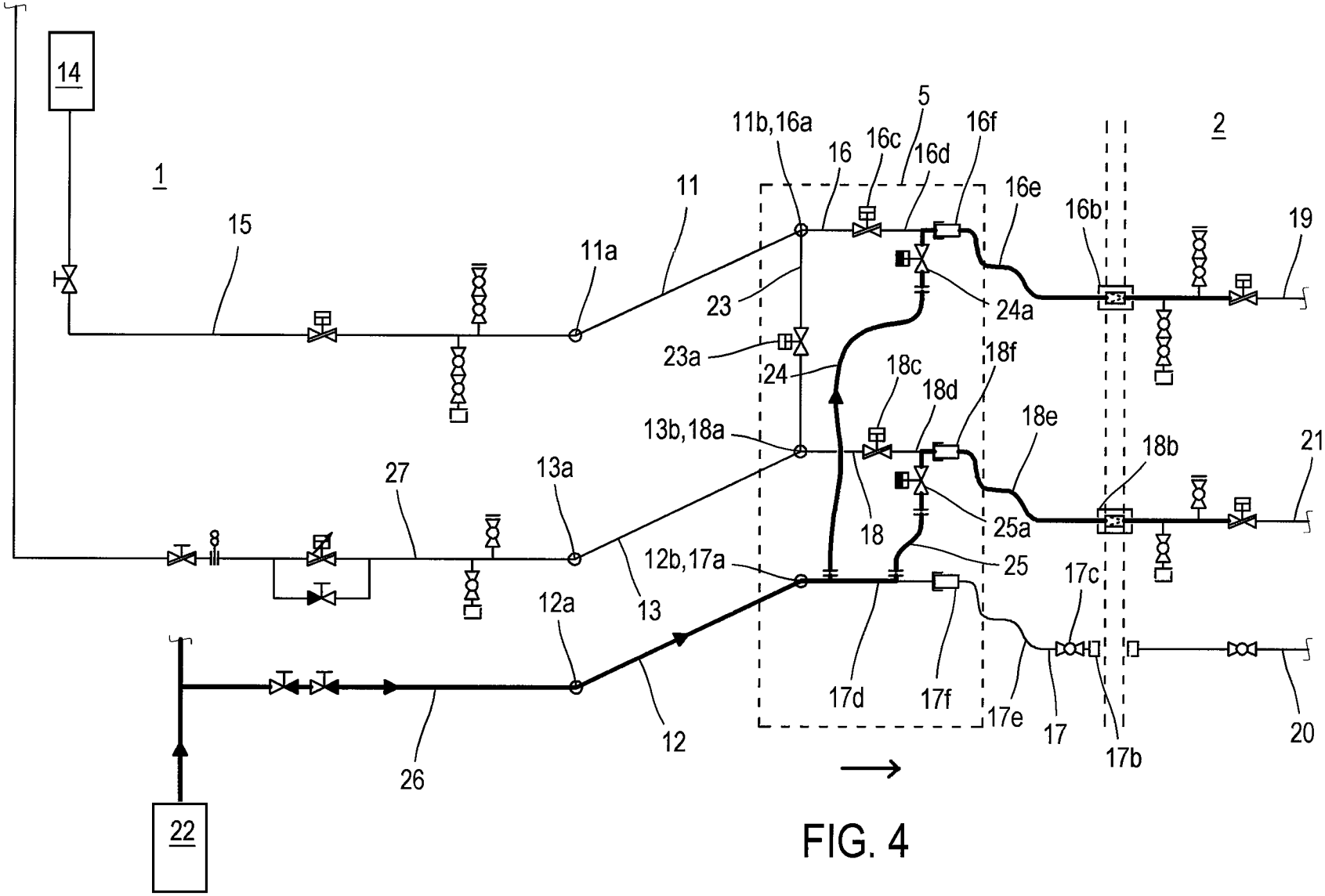
FIG. 4 illustrates schematically the circulation of the inert gas in the transfer system in FIGS. 1 and 2, during an inerting operation.

Then, the first and third on-board pipes 16, 18 are connected to the ducts 19, 21 of the client ship 2, and it is possible to proceed with a preliminary step of inerting, as represented in FIG. 4. The inert gas is conveyed from the second duct 12 to the ducts 19, 21 of the client ship by means of the connection sections 24, 25 and the second portions 16*e*, 18*e* of the first and third on-board pipes 16, 18. During this step, the valves 16*c*, 18*c* of the first and third on-board pipes 16, 18 are maintained in the closed position, and the valves 24*a*, 25*a* which equip the connection sections 24, 25 are in the open position. This operation is advantageously used to test the sealing of the connections, in particular between the first and third on-board pipes 16, 18 and the ducts 19, 21 of the client ship 2.

Figure 5:
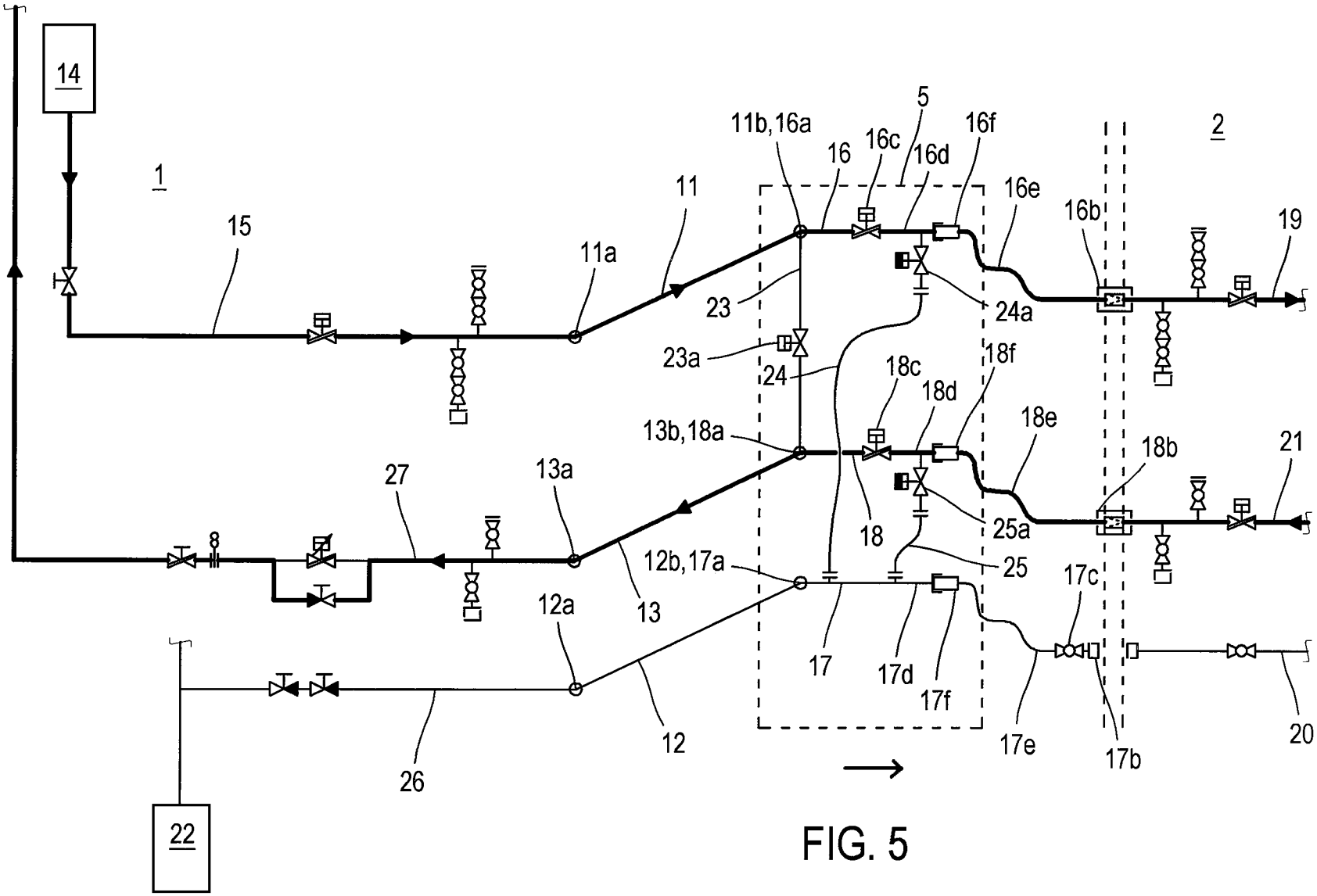
FIG. 5 illustrates schematically the circulation of the LNG in the transfer system in FIGS. 1 and 2, during an operation of transfer of LNG from the supplier ship to the client ship, and of extraction of the natural gas in the gaseous state from the client ship to the supplier ship.

When the ends of the ducts 19, 21 of the client ship 2 have been inerted, the transfer of the LNG from the supplier ship 1 to the client ship 2 can then be undertaken. The transfer operation is represented in FIG. 5. The LNG is conveyed from the LNG storage tank 14 of the supplier ship 1 to that of the client ship 2 via the first duct 11, the first on-board pipe 16 and the duct 19. The NG in the gaseous state is extracted from the LNG storage tank by means of the duct 21, the third on-board pipe 18 and the third duct 13. The valves 16*c*, 18*c* of the first and third on-board pipes 16, 18 are placed in the open position, whereas the valves 23*a*, 24*a*, 25*a* which equip the branching section 23 and the connection sections 24, 25 are closed.

Figure 6:
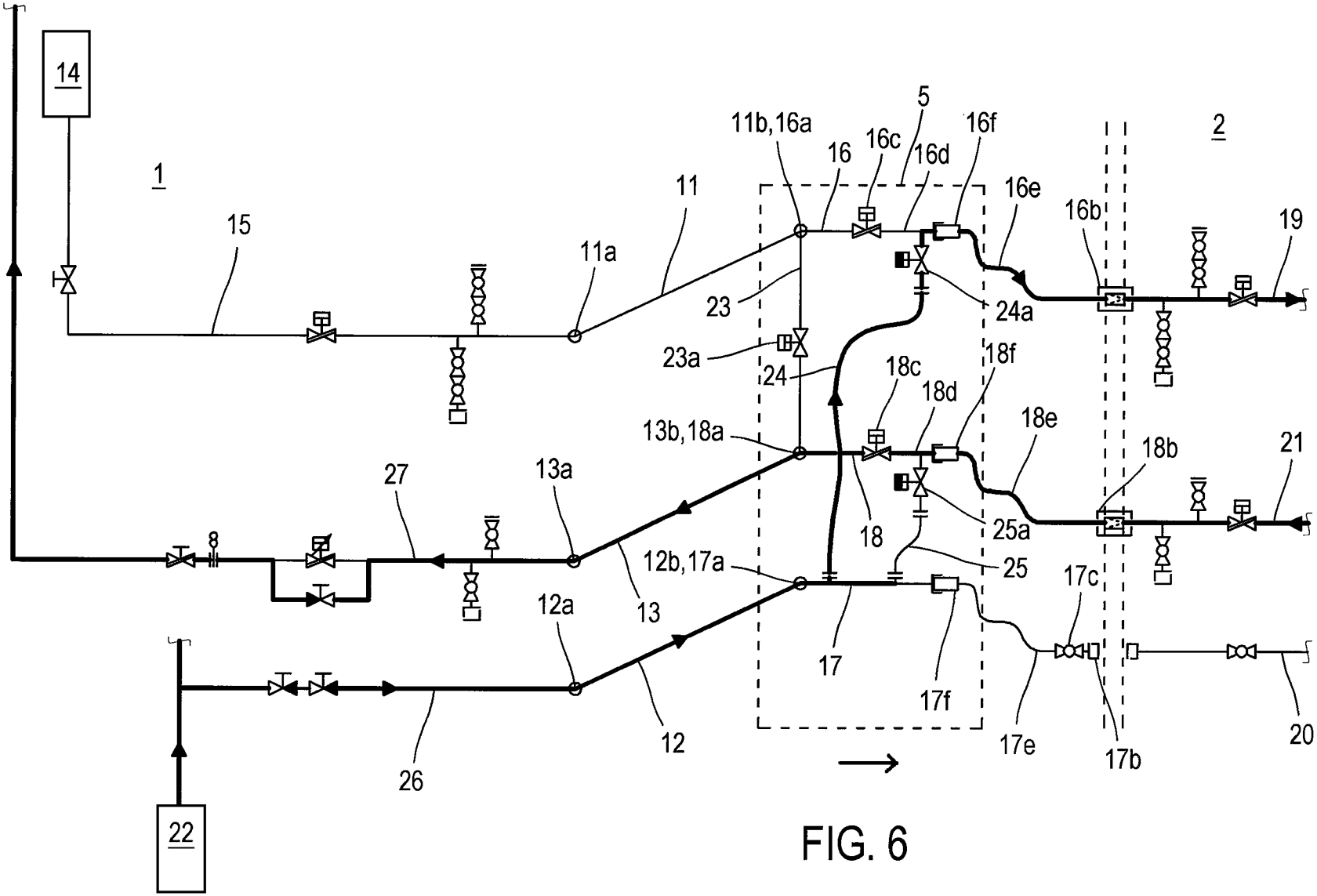
FIGS. 6 and 7 illustrate schematically the circulation of the inert gas in the transfer system in FIGS. 1 and 2, during operations aimed at draining and purging the ducts of the client ship after an operation of transfer of LNG.
Figure 7:
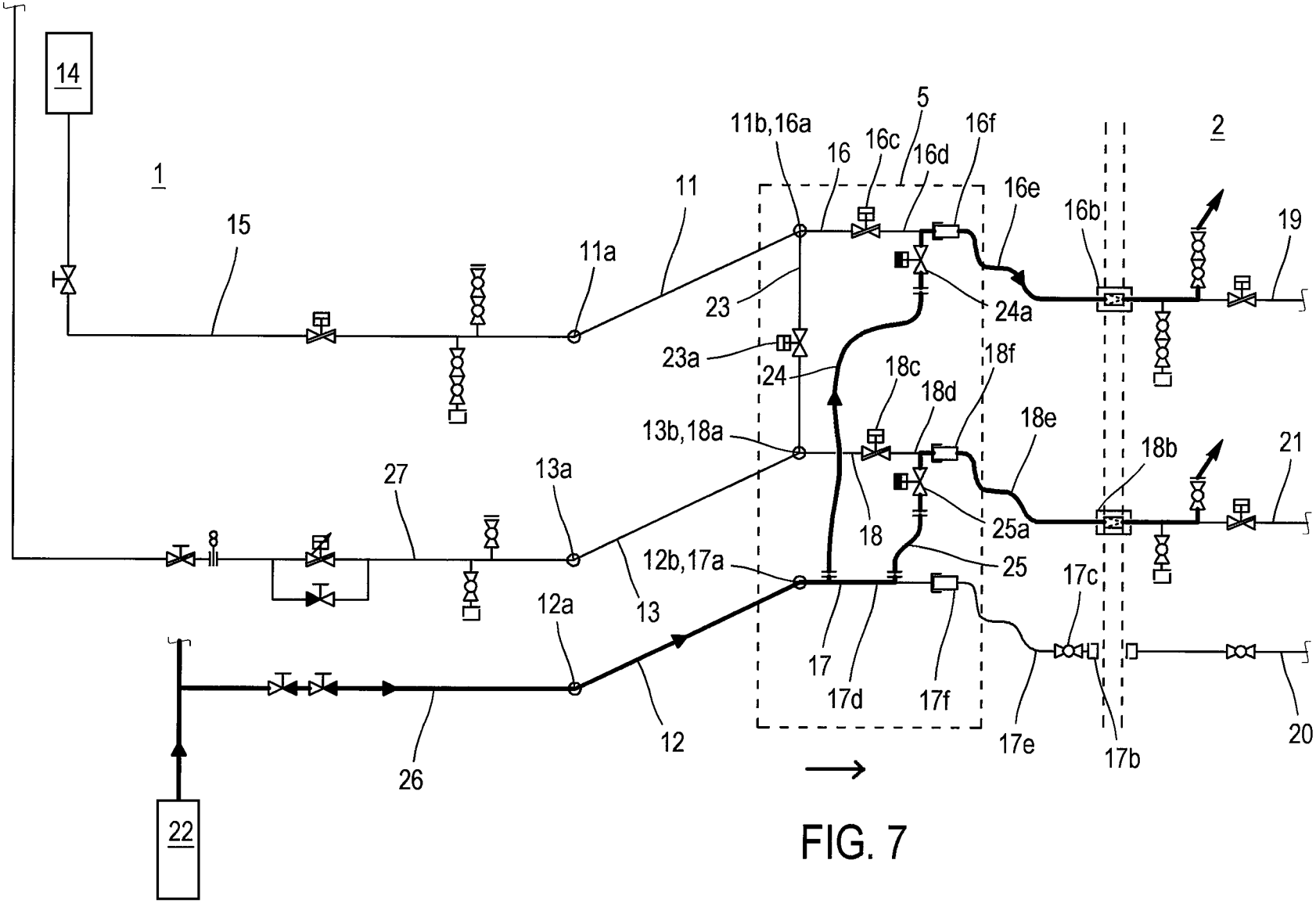

When the LNG transfer operation is completed, the duct 19 must then be drained, as illustrated in FIG. 6, then the ducts 19, 21 must be purged, as illustrated in FIG. 7.

During the operation of drainage of the duct 19 represented in FIG. 6, inert gas is conveyed from the second duct 12 to the duct 19, through a portion of the second on-board pipe 17, the connection section 24, and the second, flexible portion 16*e* of the first on-board pipe 16. The inert gas thus makes it possible to push the LNG to the LNG storage tank of the client ship 2. At the same time, the extraction of the NG in the gaseous state is maintained via the duct 21, the third on-board pipe 18 and the third duct 13. The valves 16*c*, 23*a* and 25*a* of the first on-board pipe 16, the branching section 23 and the connection section 25 are in the closed position, whereas the valves 18*c*, 24*a* of the third on-board pipe 18 and the connection section are in the open position.

Finally, during the purging operation illustrated in FIG. 7, the first and third on-board pipes 16, 18 are connected to the ducts 19, 21, and the inert gas is conveyed from the second duct 12 to the ducts 19, 21 of the client ship by means of the connection sections 24, 25 and the second, flexible portion 16*e*, 18*e* of the first and third on-board pipes 16, 18. The mixture of LNG and inert gas is then discharged in order to be burnt. During this step, the valves 16*c*, 18*c* of the first and third on-board pipes 16, 18 are maintained in the closed position, and the valves 24*a*, 25*a* which equip the connection sections are in the open position.

The first and third on-board pipes 16, 18 can then be disconnected from the ducts 19, 21 of the client ship 2.

Although the invention has been described in connection with a plurality of particular embodiments, it will be appreciated that it is in no way limited to these, and that it comprises all the technical equivalents of the means described, as well as their combinations, if these come within the scope of the invention.

The use of the verbs "contain", "comprise" or "include" and their conjugated forms does not exclude the presence of elements or steps other than those described in a claim. The use of the indefinite article "a" or "an" for an element or step does not exclude the presence of a plurality of such elements or steps, unless otherwise stated.

In the claims, any reference number in brackets cannot be interpreted as a limitation of the claim.

The invention claimed is:

1. A transfer system for transferring liquid natural gas from a ship to a facility, the transfer system comprising:

a hoisting device which is designed to be secured on a deck of the ship;

a mobile chassis, which is supported by the hoisting device;

a first duct, for transferring liquid natural gas from the ship to the facility, which has a first end designed to be connected to a liquid natural gas storage tank of the ship, and a second end;

a second duct, for the transport of inert gas, comprising a first end which is designed to be connected to an inert gas storage tank of the ship, and a second end;

a first on-board pipe for transferring liquid natural gas from the ship to the facility, said first on-board pipe being supported by the mobile chassis and comprising:

a first connection element which is associated with the second end of the first duct;

a second connection element which is designed for the connection of the first on-board pipe to a duct of the facility for transferring liquid natural gas to the facility;

a valve which is arranged between the first and the second connection elements of the first on-board pipe; and an emergency release coupling which is arranged between the valve and the second connection element of the first on-board pipe; and a second on-board pipe for the transport of inert gas, said second on-board pipe being supported by the mobile chassis, and comprising;

a first connection element which is associated with the second end of the second duct, a second connection element which is designed for the connection of the second on-board pipe to a duct of the facility for transferring inert gas to the facility, a valve which is arranged between the first and second connection elements of the second on-board pipe;

an emergency release coupling which is arranged between the first and the second connection elements of the second on-board pipe;

the second on-board pipe being connected to the first on-board pipe, by means of a first connection section which opens into the first on-board pipe between the valve of the first on-board pipe and the second connection element of the first on-board pipe and into the second on-board pipe downstream of the first connection element of the second on-board pipe and upstream of the valve and the emergency release coupling of the second on-board pipe, the first connection section allowing the inerting of a part of the first on-board pipe on the facility side.

2. The transfer system as claimed in claim 1, comprising:

a third duct for the extraction of the natural gas in a gaseous state from the facility to the ship, the third duct comprising a first end which is designed to be connected to equipment of the ship, and a second end; and a third on-board pipe for the extraction of the natural gas in the gaseous state from the facility to the ship, said third on-board pipe being supported by the mobile chassis and comprising:

a first connection element which is associated with the second end of the third duct;

a second connection element which is designed for the connection of the third on-board pipe to a duct of the facility for extraction of the natural gas in the gaseous state from the facility; and a valve which is arranged between the first and the second connection elements;

wherein the second on-board pipe is connected to the third on-board pipe by means of a second connection which opens into the third on-board pipe, between the valve and the second connection element of the third on-board pipe and into the second on-board pipe between the first connection element and the valve of the second on-board pipe.

3. The transfer system as claimed in claim 2, comprising a branching section which is supported by the mobile chassis, equipped with a valve and connecting the first on-board pipe, between the first connection element and the valve of the first on-board pipe, to the third on-board pipe, between the first connection element and the valve of the third on-board pipe.

4. The transfer system as claimed in claim 2, wherein the first connection section and the second connection section are each equipped with a valve.

5. The transfer system as claimed in claim 1, wherein at least one out of the first on-board pipe, the second on-board pipe and the third on-board pipe is equipped with an emergency disconnection device.

6. The transfer system as claimed in claim 5, where at least one out of the first on-board pipe, the second on-board pipe and the third on-board pipe comprises a flexible portion which, firstly, is connected to an emergency disconnection device, and secondly has a free end supporting a second connection element which can be connected to a pipe of the facility.

7. The transfer system as claimed in claim 1, wherein the first duct, the second duct and/or the third duct is/are flexible.

8. The transfer system as claimed in claim 1, wherein the first duct, the second duct and/or the third duct comprise(s) at least two rigid portions which are connected to one another by at least one rotating joint.

9. The transfer system as claimed in claim 1, wherein the mobile chassis comprises an element for temporary securing of the mobile chassis on the facility.

10. The transfer system as claimed claim 9, wherein the element for temporary securing of the mobile chassis on the facility is a sucker which is connected to a vacuum generator, or an electromagnet.

11. The transfer system as claimed in claim 1, wherein the hoisting device is an articulated arm comprising a hydraulic or pneumatic actuating device.

12. The transfer system as claimed in claim 11, which additionally comprises a control device which can place the actuating device selectively in an active state, in which the pressure in the actuating device is regulated in order to permit retention in position and/or displacement of the articulated arm, and in a released state, in which the pressure in the actuating device is released, in order to shut off the articulated arm, such that it can follow the relative movements between the ship and the facility.

13. The transfer system as claimed in claim 11, additionally comprising a control device which can place the actuating device selectively in an active state, in which the pressure in the actuating device is regulated in order to permit retention in position and/or displacement of the articulated arm, and in a support assistance state, in which the actuating device is maintained under pressure, at a pressure lower than a pressure of equilibrium, whilst permitting its displacement, in order to allow the system to follow the relative movements of the ships, whilst continuing to support partly the mobile chassis.

14. A ship which is equipped with a transfer system as claimed in claim 1.

15. A method for transferring liquid natural gas from a ship to a facility by means of a transfer system, said transfer system being connected to a facility comprising a first duct of the ship for transferring the liquid natural gas to the facility, which is firstly connected to a liquid natural gas storage tank of the facility, and secondly is connected to a first on-board pipe of the transfer system;

a hoisting device which is designed to be secured on a deck of the ship;

a mobile chassis, which is supported by the hoisting device;

a first duct, for transferring liquid natural gas from the ship to the facility, which has a first end connected to a liquid natural gas storage tank of the ship, and a second end;

a second duct of the ship, for the transport of inert gas, comprising a first end which is connected to an inert gas storage tank of the ship, and a second end;

a first on-board pipe for transferring liquid natural gas from the ship to the facility, said first on-board pipe being supported by the mobile chassis and comprising:

a first connection element which is associated with the second end of the first duct of the ship;

a second connection element which is designed for the connection of the second on-board pipe to a duct of the facility for transferring inert gas to the facility; and a valve which is arranged between the first and the second connection elements of the second on-board pipe; and an emergency release coupling which is arranged between the valve and the second connection element of the first on-board pipe; and a second on-board pipe for the transport of inert gas, said second on-board pipe being supported by the mobile chassis and comprising:

a first connection element which is associated with the second end of the second duct of the ship, a second connection element which is designed for the connection of the second on-board pipe to a second duct of the facility for transferring inert gas to the facility, a valve which is arranged between the first and second connection elements of the second on-board pipe, an emergency release coupling which is arranged between the first and the second connection elements of the second on-board pipe;

the second on-board pipe being connected to the first on-board pipe by means of a first connection section which opens into the first on-board pipe between the valve of the first on-board pipe and the second connection element of the first on-board pipe and into the second on-board pipe downstream of the first connection element of the second on-board pipe and upstream of the valve and the emergency release coupling of the second on-board pipe, the first connection section allowing the inerting of a part of the first on-board pipe on the facility side; said method comprising:

an inerting step, in which the valve of the first on-board pipe is in the closed position and inert gas is conveyed from the second duct of the ship to the first duct of the facility by means of the second on-board pipe and the first on-board pipe.

16. The method for transferring liquid natural gas as claimed in claim 15, wherein said facility additionally comprises a second duct for extraction of the natural gas in the gaseous state, which is firstly connected to the liquid natural gas storage tank of the facility, and secondly connected to the third on-board pipe of the transfer system, the transfer system further comprising a third duct for the extraction of the natural gas in a gaseous state from the facility to the ship, the third duct comprising a first end which is connected to equipment of the ship, and a second end; and a third on-board pipe for the extraction of the natural gas in the gaseous state from the facility to the ship, said third on-board pipe being supported by the mobile chassis and comprising:

a first connection element which is associated with the second end of the third duct of the ship;

a second connection element which is designed for the connection of the third on-board pipe to the duct of the facility for extraction of the natural gas in the gaseous state from the facility; and a valve which is arranged between the first and the second connection elements;

wherein the second on-board pipe is connected to the third on-board pipe between the valve and the second connection element of the third on-board pipe;

wherein, during the inerting step, the valve of the third on-board pipe is in the closed position, and inert gas is conveyed from the second duct to the second duct of the facility by means of the second on-board pipe and the third on-board pipe.

17. The method for transferring liquid natural gas as claimed in claim 16, wherein the transfer system comprises a branching section which is supported by the mobile chassis, equipped with a valve and connecting the first on-board pipe, between the first connection element and the valve of the first on-board pipe, to the third on-board pipe, between the first connection element and the valve of the third on-board pipe, said method comprising a step of cooling the first and third ducts (11, 13), during which the valves (16*c*, 18*c*) of the first and third on-board pipes (16, 18) are in the closed position, and the valve (23*a*) of the branching section (23) is in the open position, and liquid natural gas is conveyed from the first duct (11) to the third duct (13) through the branching section (13).

* * * * *